US010755828B2

(12) United States Patent
Mathias-Laot et al.

(10) Patent No.: US 10,755,828 B2
(45) Date of Patent: Aug. 25, 2020

(54) DEVICE FOR PREPARING RADIOACTIVE SOLUTIONS

(71) Applicant: UNIVERSITE DE LORRAINE, Nancy (FR)

(72) Inventors: Guénolé Mathias-Laot, Nancy (FR); Quentin Thomas, Laneuville devant Nancy (FR)

(73) Assignee: UNIVERSITE DE LORRAINE, Nancy (FR)

( * ) Notice: Subject to any disclaimer, the term of this patent is extended or adjusted under 35 U.S.C. 154(b) by 0 days.

(21) Appl. No.: 16/466,806

(22) PCT Filed: Dec. 5, 2017

(86) PCT No.: PCT/EP2017/081532
§ 371 (c)(1),
(2) Date: Jun. 5, 2019

(87) PCT Pub. No.: WO2018/104306
PCT Pub. Date: Jun. 14, 2018

(65) Prior Publication Data

US 2019/0341162 A1 Nov. 7, 2019

(30) Foreign Application Priority Data

Dec. 7, 2016 (FR) ..... 16 62069

(51) Int. Cl.
*G21F 7/005* (2006.01)
*B65B 3/00* (2006.01)
(Continued)

(52) U.S. Cl.
CPC ..... *G21F 7/005* (2013.01); *B65B 3/006* (2013.01); *G21F 5/015* (2013.01); *G21G 1/0005* (2013.01)

(58) Field of Classification Search
CPC ..... G21F 7/005; G21F 5/015; B65B 3/006; G21G 1/0005
(Continued)

(56) References Cited

U.S. PATENT DOCUMENTS 4,665,758 A 5/1987 Schaarschmidt
2010/0206425 A1* 8/2010 Tartaglia ..... B65B 3/003 141/1

FOREIGN PATENT DOCUMENTS

BE 902407 R 9/1985
WO 2008/049240 A1 5/2008

OTHER PUBLICATIONS

International Preliminary Report on Patentability from Corresponding International Application No. PCT/EP2017/081532 dated Jun. 11, 2019.
(Continued)

*Primary Examiner* — Michael Maskell
(74) *Attorney, Agent, or Firm* — Pearne & Gordon LLP

(57) ABSTRACT

A device for preparing radioactive solutions, in particular radiopharmaceutical solutions, including: a movable support block with at least two cells capable of accommodating a vial; and a shielded covering, including a side wall surrounding the periphery of the support block and an upper wall covering the upper face of the support block, an opening being provided in the upper wall of the covering. A means for driving the support block is configured to selectively displace the support block into positions, referred to as working positions, in which a given cell is aligned with the opening to allow access to the cell from the outside of the covering. The support block is configured such that it can be further brought to a position, referred to as closing position, in which the opening is sealed by a shielded element carried by the support block.

15 Claims, 7 Drawing Sheets

Figure 1:
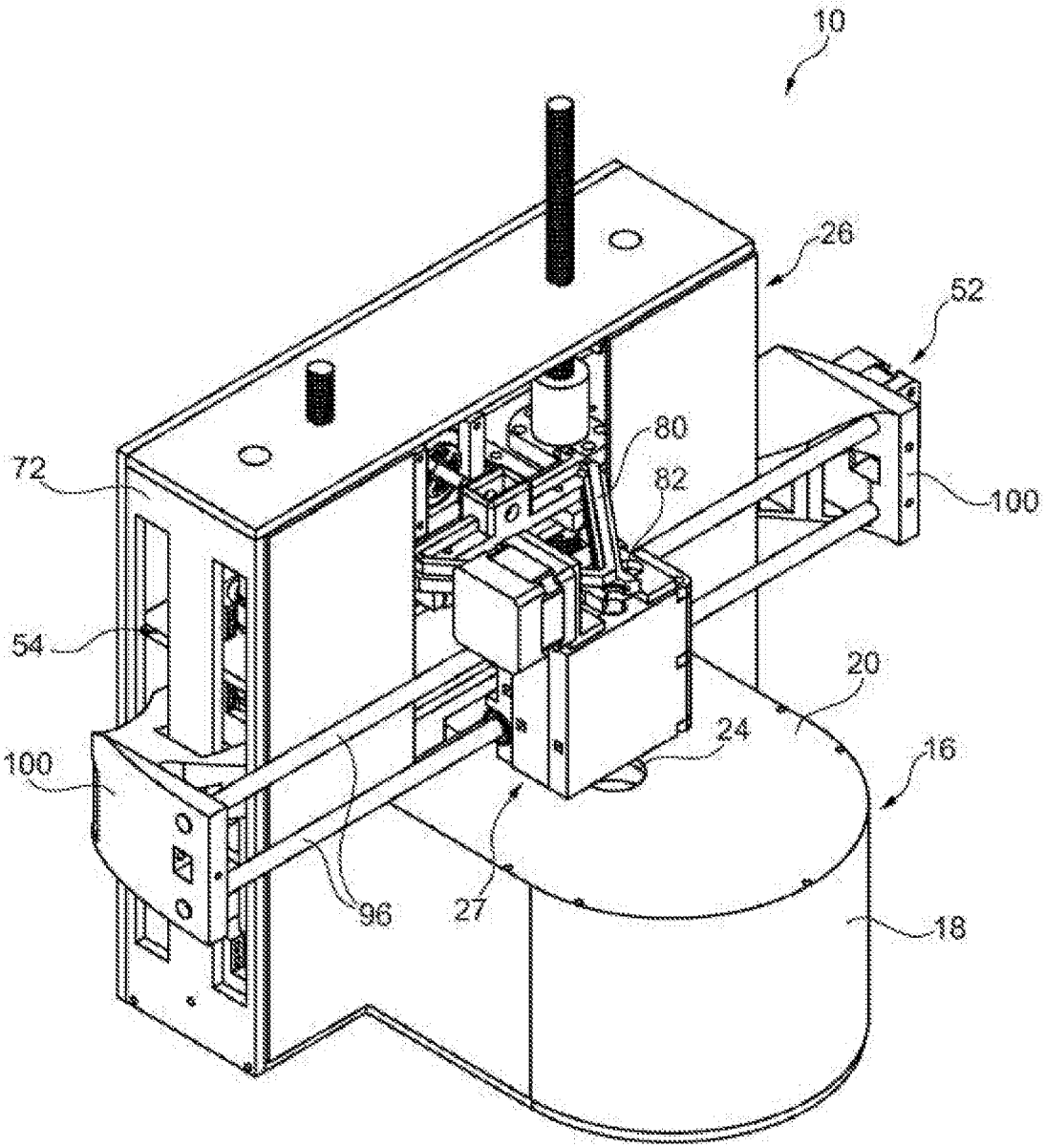

(51) Int. Cl.
*G21F 5/015* (2006.01)
*G21G 1/00* (2006.01)

(58) Field of Classification Search
USPC ..... 250/497.1, 498.1
See application file for complete search history.

(56) References Cited

OTHER PUBLICATIONS

English translation of Written Opinion from Corresponding International Application No. PCT/EP2017/081532 dated Mar. 7, 2018.
International Search Report from Corresponding International Application No. PCT/EP2017/081532 dated Mar. 7, 2018.
Written Opinion from Corresponding International Application No. PCT/EP2017/081532 dated Mar. 7, 2018.

* cited by examiner

DEVICE FOR PREPARING RADIOACTIVE SOLUTIONS

TECHNICAL FIELD

The field of the invention is that of the preparation of radioactive solutions, and in particular radiopharmaceutical drugs. The invention concerns more particularly a device for preparing such radioactive solutions and radiopharmaceutical drugs.

STATE OF THE ART

As is known, the drugs referred to as «radiopharmaceuticals» (RPM) contain artificial radioelements called radionuclides, which are used for diagnostic or therapeutic purposes and used in the nuclear medicine services. These drugs are either in the form of proprietary medicine containing radionuclides which are delivered ready for use, or in the form of radiopharmaceutical preparations which are prepared in situ and extemporaneously by labelling of carrier molecules, designated «kits» by those skilled in the art, with a selected radionuclide derived from a generator. The most frequently used radionuclide in nuclear medicine is technetium 99m ($^{99m}$Tc), which is easily available thanks to the generator $^{99m}$Mo/$^{99m}$Tc and which is administered in the form of a sodium pertechnetate solution. This solution is obtained by elution to give technetium 99m eluates in the form of sterile, pyrogen-free solutions. More specifically, the carrier molecules forming these kits are sterile and pyrogen-free substances, which are most often prepackaged in the form of vacuum-closed kit vials.

In a known manner, shielded enclosures (against the radiation from the isotopes), provided with glove port type openings, on the edges of which, latex gloves where the operators insert their hands are fastened, are generally used for the preparation of these drugs. Some centers use enclosures devoid of integral gloves, replaced by traditional latex or nitrile single-use gloves worn by the user and changed at each manipulation. This practice is justified by the fact that the gloves secured to the enclosure are too thick and affect the agility of the technicians, more comfortable with traditional thin gloves. Thus, the «time» factor is played on to be protected from the radiation. The preparations are made by transfer of a diluted eluate into the kit vial using single-use syringes. Once the RPM solution has been prepared, and passed through the activimeter, a lead-sealed syringe protector is installed on the syringe.

The major drawbacks of these traditional preparation methods lie in the existence of very high radioactive dose rates in contact with the tips of the operator's fingers upon the manipulation of the syringes, during the labelling/reconstitution and fractionation steps, while the vials can be manipulated with clamps.

OBJECT OF THE INVENTION

The object of the invention is to provide a device for preparing radiopharmaceuticals which allows an automated preparation of radioactive solutions and minimizes the exposure of operators to radiation emitted by the radionuclides.

GENERAL DESCRIPTION OF THE INVENTION

With this objective in mind, the present invention proposes a device for preparing radioactive solutions comprising:

a movable support block comprising at least two cells capable of accommodating a vial;

an (anti-radiation) shielded covering, comprising a side wall surrounding the periphery of the support block and an upper wall covering the upper face of the support block, an opening being provided in the upper wall of the covering;

a means for driving the support block configured to selectively displace the block into positions, referred to as working positions, in which a given cell is aligned with the opening to allow access to said cell from the outside of the covering;

a syringe carrier associated with a syringe actuating means configured to displace a syringe substantially vertically in the axis of the opening and to actuate a plunger of said syringe.

It will be appreciated that the support block is configured such that it can be further brought to a position, referred to as closing position, in which the opening is sealed by a shielded element carried by the support block.

The existence of the closing position of the movable support block, inherent thereto, therefore allows closing the communication by the opening of the shielded covering, between the inside thereof and the outside. Since the single opening is closed by a shielded element, the radiation emitted by the isotopes is also blocked. An operator can therefore do manipulations above the device, even at the vertical of the opening of the covering, without fear of a significant dose rate.

The device, equipped with several cells, allows carrying out the preparations required for the use of RPM, whether they are reconstitutions, labellings and fractionations, or simple dilutions and transfers between vials. As will be understood, the use of the device is not limited to the preparation of RPM, but can be used for the preparation of any radioactive solution.

The shielded element carried by the support block can be integral therewith, for example, if the support block is also made of material allowing blocking or attenuating the radiation from the isotopes, or attached therein. The shielded element may for example be a disc made of lead-based material (or other appropriate anti-radiation material) placed in a housing opening into an upper face of the movable support block.

The shielded covering is made of any material allowing attenuating or blocking the passage of the radiation emitted by the isotopes placed in the covering, for example of lead, lead-based material, or other anti-radiation materials. The thickness of the shielded covering is adjusted depending on the contained doses and the desired attenuation.

According to a preferred embodiment, the movable support block is a rotatably mounted cylindrical barrel, preferably along a substantially vertical central axis, and wherein the cells open into the upper face of the barrel. The cells and the housing of the shielded element are positioned in the barrel so as to be able to selectively bring them, by rotation of the barrel, into alignment with the opening of the covering.

According to the variants, the device has one or more of the following technical features:

- the cells capable of accommodating vials are cylindrical cells inclined relative to the vertical;
- one or more cell(s) comprise(s) a temperature sensor and/or a precision balance at the bottom of the cell; and/or
- means for detecting the angular position of the movable support block, preferably optical detection means;

heating and/or cooling means are associated with at least one of the cells;

a cell is made as an insert mounted in a hollow portion of the support block, the heating and/or cooling means comprising a heater resistor mounted on a jacket disposed in a cell, as well as a fan mounted in the support block and ventilation openings in the side wall of the support block.

a disinfection means equips at least one, preferably each of the cells. It comprises, for example, a circular ramp of UV emitters at around 254 nm, positioned on the upper circumference of the cell and preferably oriented towards the inside of the cell, towards the vial.

Preferably, the syringe actuating means comprises a first mobile member to which the syringe carrier is secured, the syringe carrier ensuring holding the syringe body; and a second mobile member with means for coupling to the syringe plunger. The syringe actuating means is configured to, either simultaneously displace the first and second mobile members, or to perform a displacement of the second mobile member relative to the first mobile member.

The device also advantageously comprises translation means mounted on the first mobile member, in order to displace the syringe carrier laterally relative to the support block; and/or the syringe carrier is associated with a support and comprises means to displace the syringe carrier downwardly relative to its support. These measures allow disengaging the syringe from the barrel area in order, among others, to bring it into an adjacent measuring/monitoring device or to deposit it in a case.

DETAILED DESCRIPTION USING THE FIGURES

Figure 2:
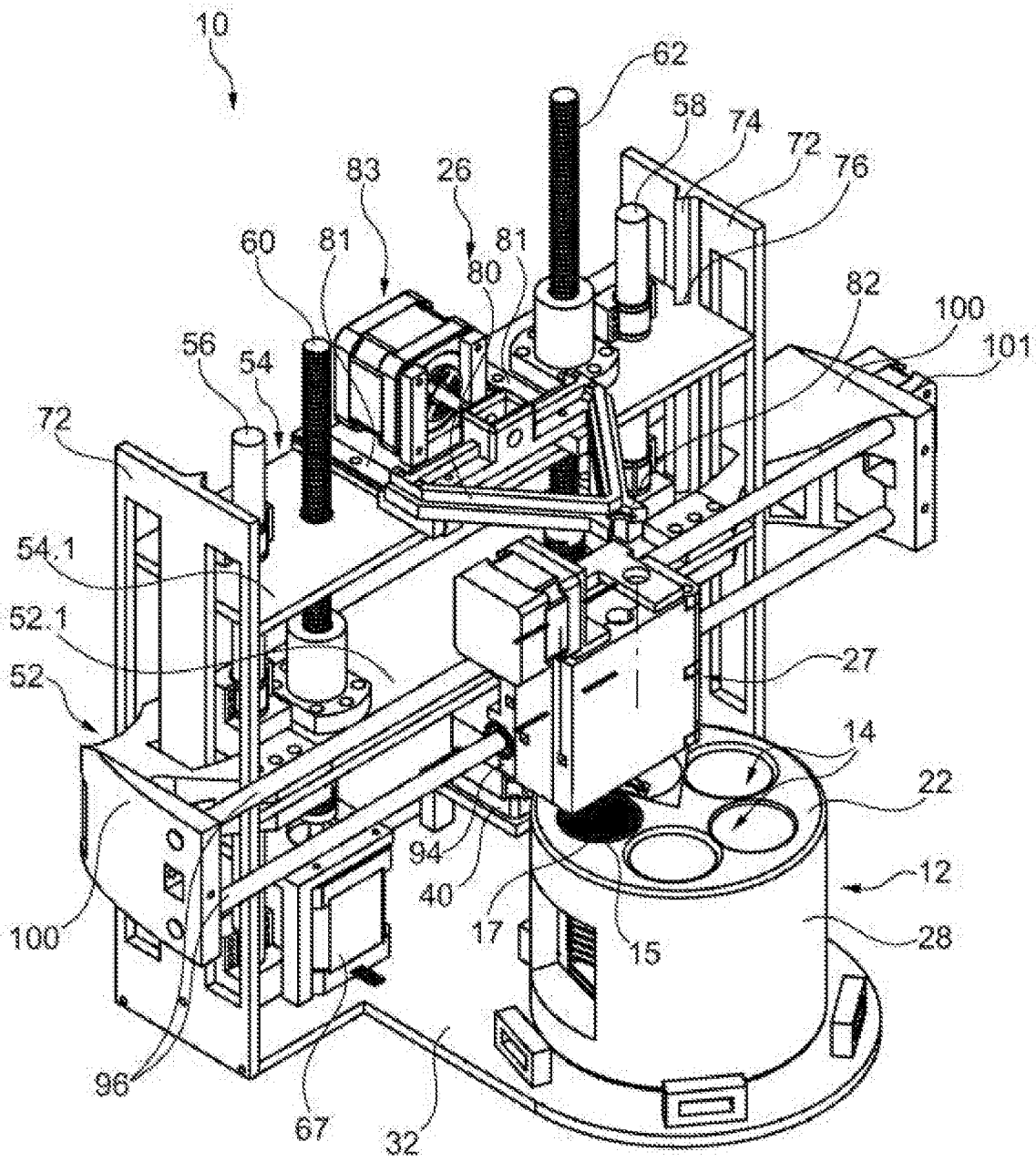
Figure 3:
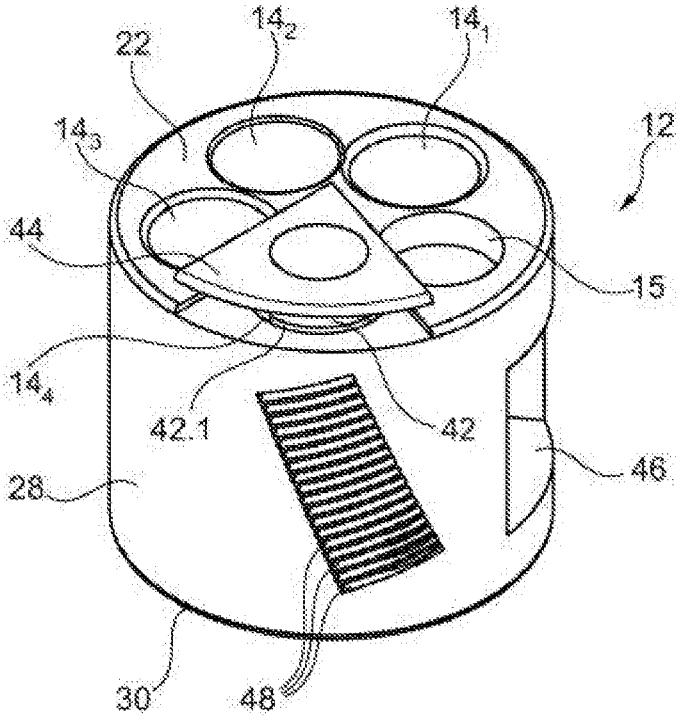
Figure 4:
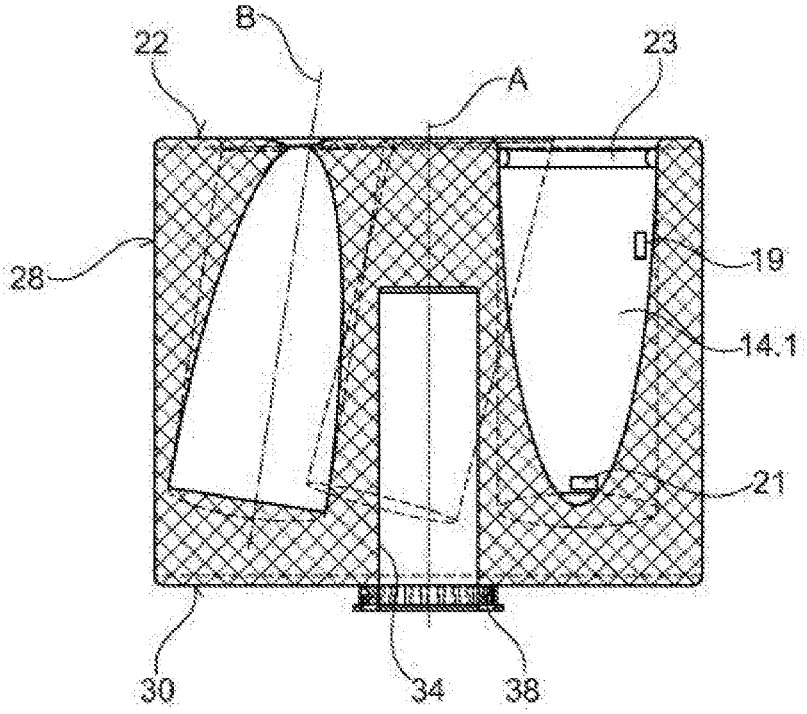
Figure 5:
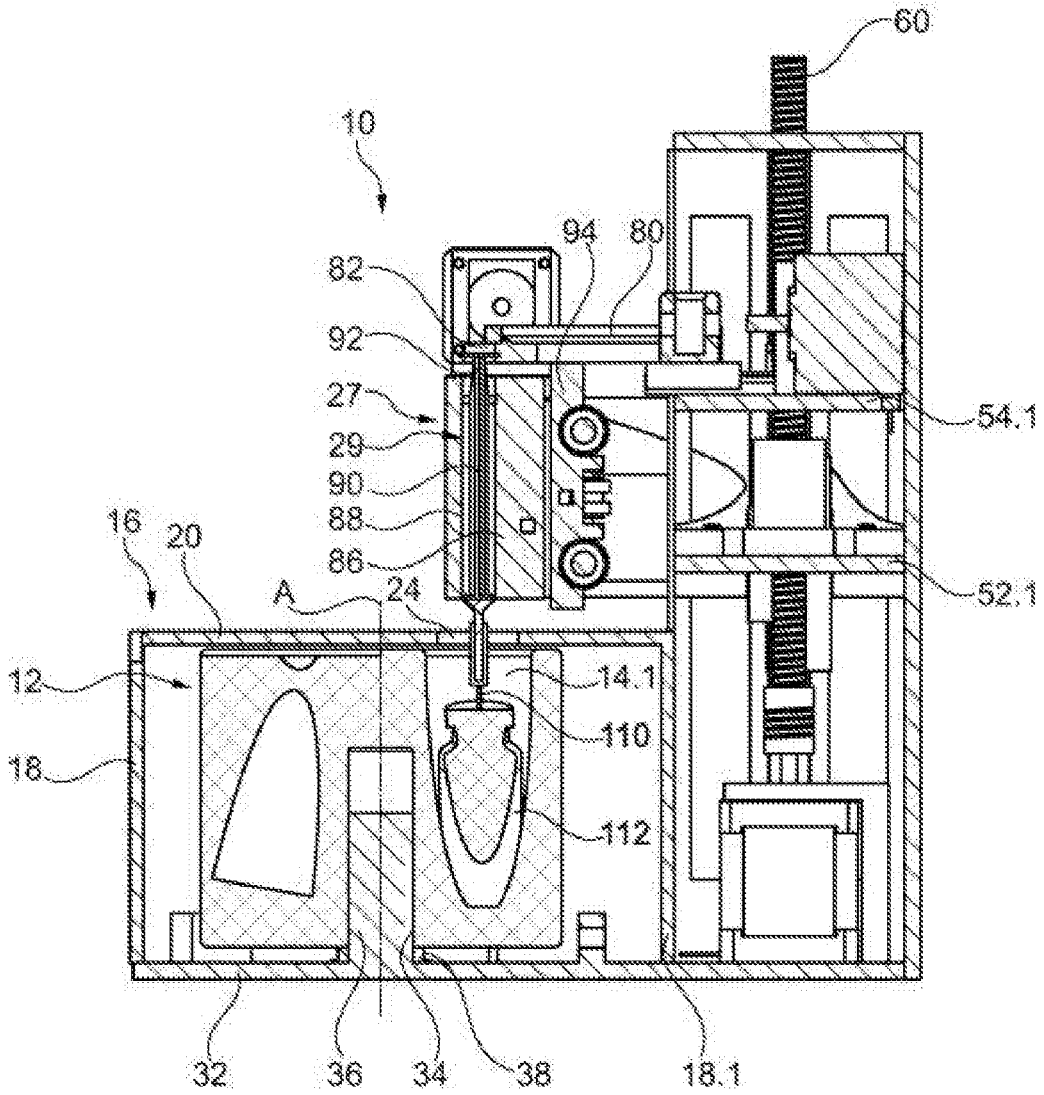
Figure 6:
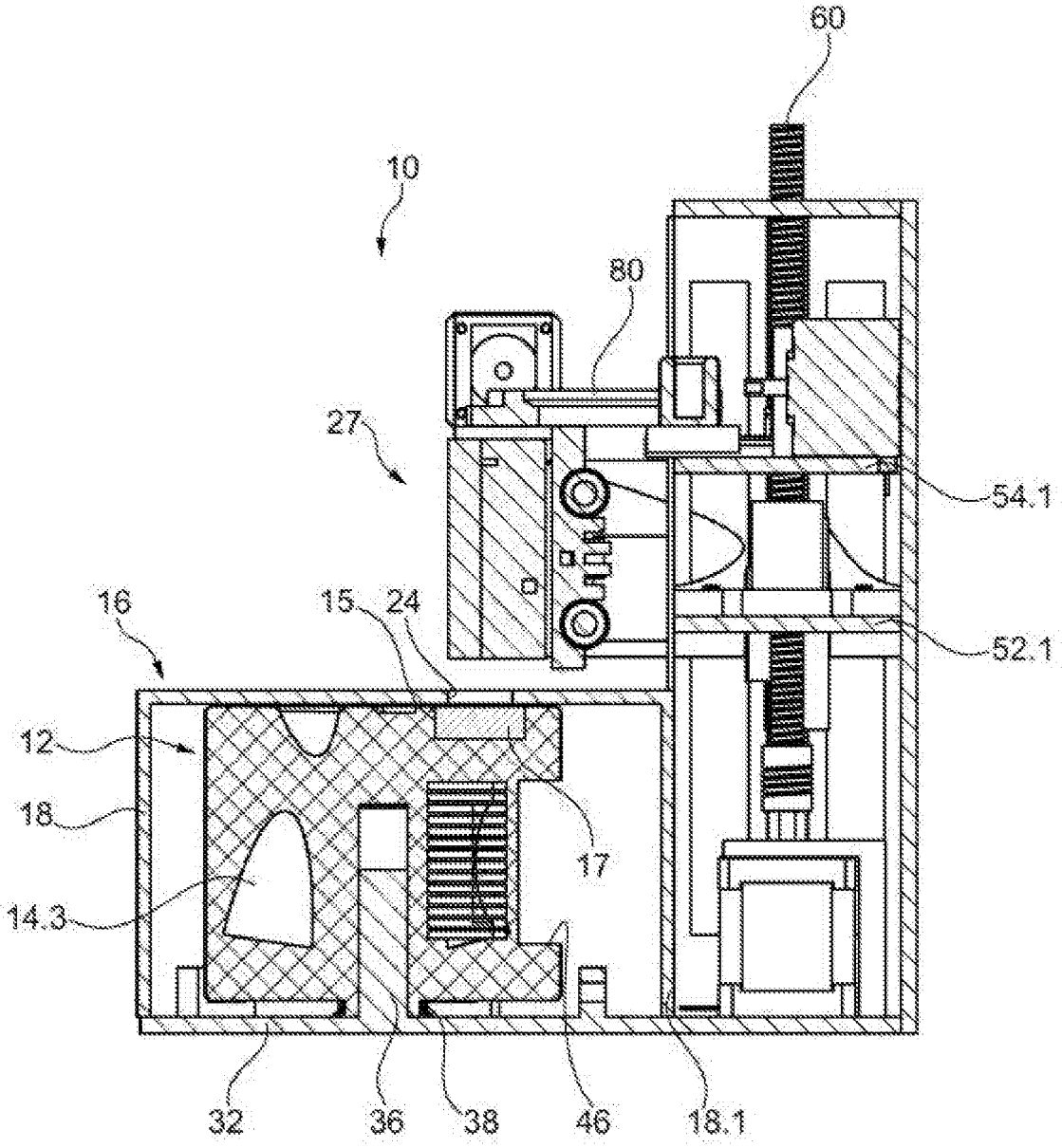
Figure 7:
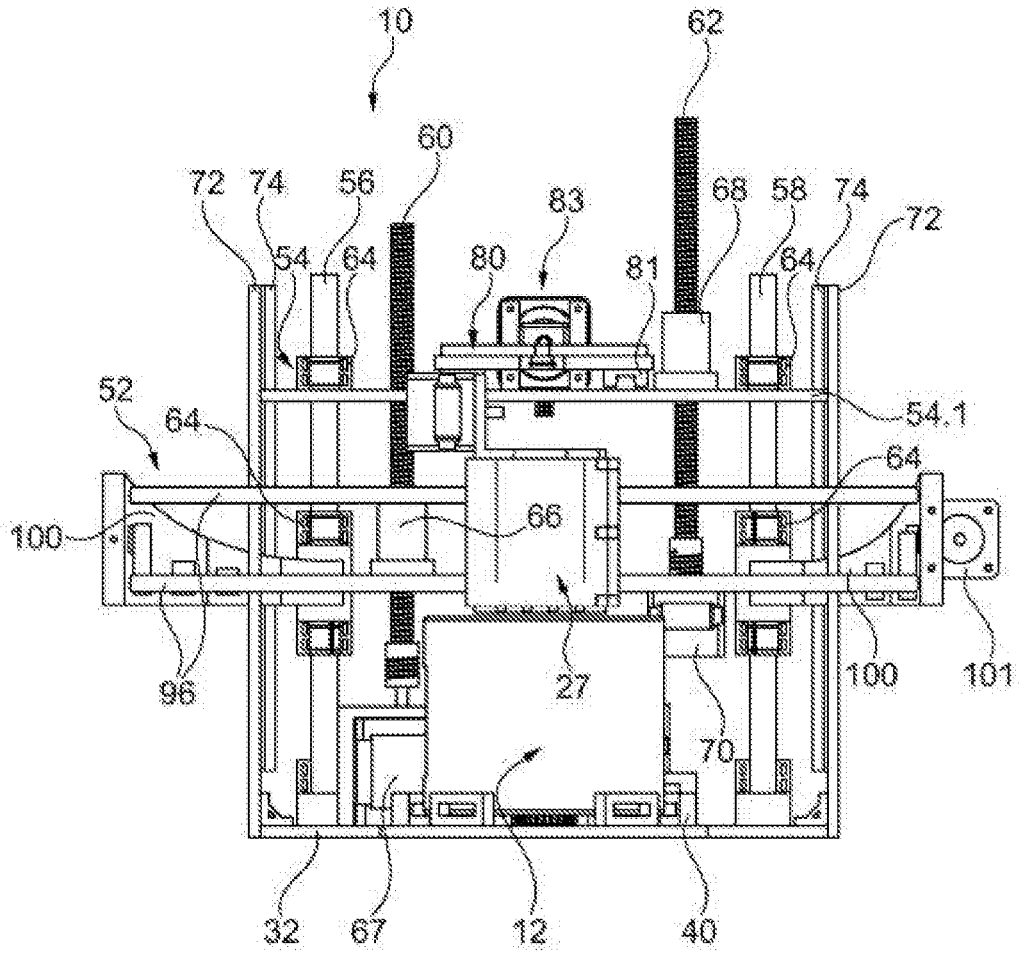
Figure 8:
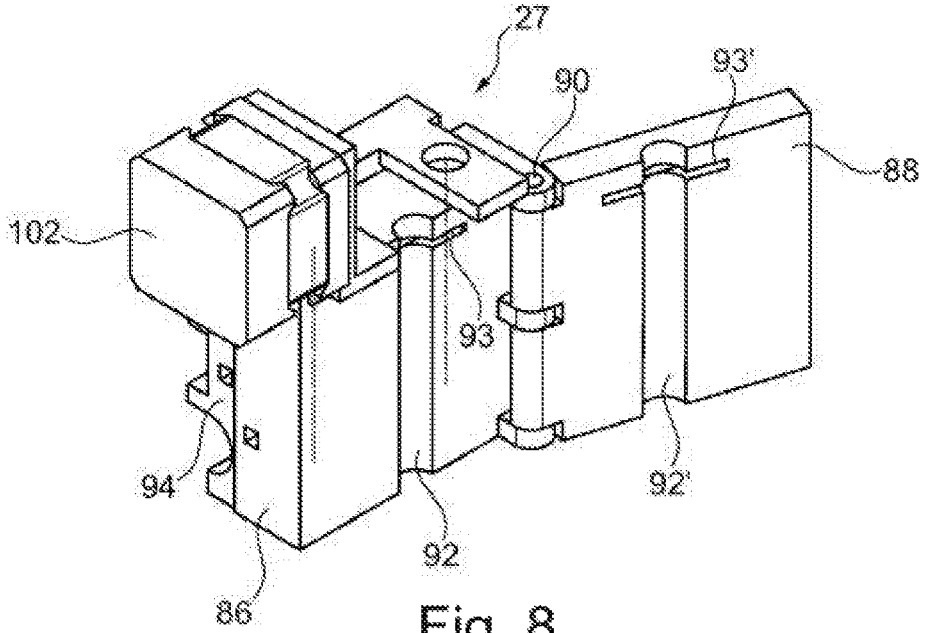
Figure 9:
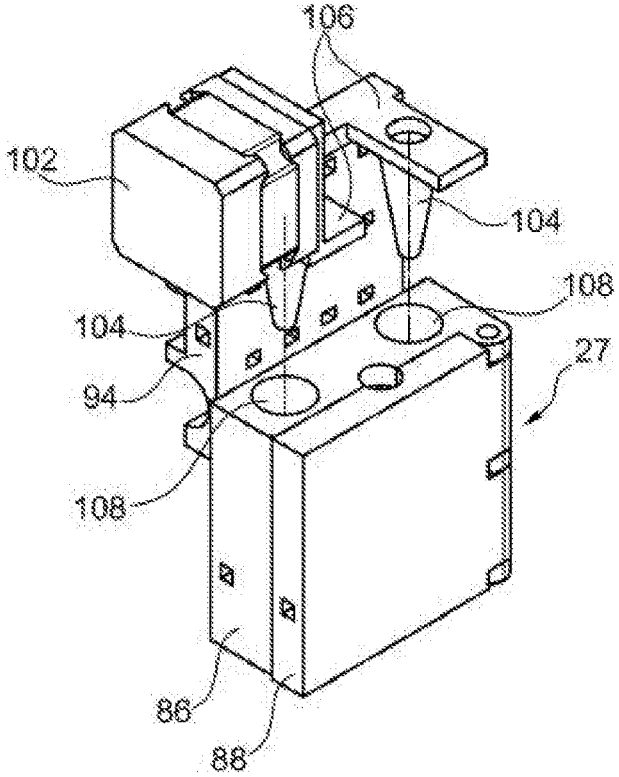

Other particularities and features of the invention will emerge from the detailed description of at least one advantageous embodiment presented below, by way of illustration, with reference to the appended drawings. These show:

FIG. 1: a perspective view of an embodiment of a device for preparing radiopharmaceutical injections according to the invention;

FIG. 2: a perspective view of the device of FIG. 1, without the shielded casing, FIG. 3: a perspective view of the barrel;

FIG. 4: a vertical sectional view, through the central axis of the barrel;

FIG. 5: a sectional view of the device of FIG. 1, with the barrel in the working position;

FIG. 6: a sectional view of the device of FIG. 1, with the barrel in the closing position;

FIG. 7: a front view of FIG. 2;

FIG. 8: a perspective view of the syringe casing, which cover is open;

FIG. 9: a perspective view of the syringe casing, lowered on its support.

The present invention concerns a device for preparing radioactive solutions and in particular radiopharmaceutical preparations allowing withdrawing products from vial, in an automated manner, and ensuring the safety of the user. The device is in particular designed to allow the preparation of RPM, including RPM injections, combining a radioisotope with a vector, that is to say a molecule (or fragment) selected to be selectively localized on a particular structure of the organism.

Referring first to FIGS. 1 and 2, the device 10 for preparing RPM injections which comprises a movable support block 12 comprising several cells 14 capable of accommodating a vial. As will be understood later, the support block 12 is intended to accommodate different vials for the reconstitution of RPM or the fractioning thereof, in order to prepare injections. Typically, the used vials are penicillin vial sized glass vials (example: diameter 2.5 cm, height 5.5 cm) provided with a rubber cap on the upper opening and called "kits". Other vials can of course be used, and the dimensions of cells 14 adapted accordingly.

Since some vials will contain a radioactive isotope, the device advantageously comprises a shielded protective casing around the support block. In FIG. 1, the protective casing is a «shielded» covering 16, which comprises a side wall 18 surrounding the periphery of the support block 12 and an upper wall 20 covering the upper face 22 of the support block 12. An opening 24 is provided in the upper wall 20 of the casing, to allow access to the cells 14. The shielded covering 16 can be made of lead, for example with a thickness in the range of, for example, 9 to 30 mm or any other material allowing shielding (attenuating or blocking) emissions from radionuclides. The wall thickness is selected to attenuate the ionizing radiation according to the material used and the dose of isotopes. Preferably the upper wall 20 of the covering 16 is removable, to allow the loading/unloading of vials in the cells 14.

The reference sign 26 generally refers to a syringe actuating means configured to displace a syringe vertically, substantially in the axis of the opening, and to actuate a plunger of said syringe, as described in more detail hereinafter. The reference sign 27 refers to a syringe carrier for a syringe 29 (shown in FIG. 5).

As shown in FIG. 2, the support block 12 is preferably made as a rotary barrel, a term which will be adopted for the following description. The device 10 comprises a means for driving the barrel 12 which is configured to selectively displace the barrel 12 into positions, referred to as working positions, in which a given cell 14 is aligned with the opening 24 to allow access to the cell 14 from the outside of the casing 16.

The barrel 12 comprises a generally cylindrical body, with a cylindrical side face 28 of an axis A, the upper face 22 and a lower face 30. In the device, the barrel 12 is arranged with the lower face 30 thereof turned downwards. The barrel 12 is rotatably mounted on a platen 32 which forms the base of the device 10 and also supports the shielded covering 16 (the platen 32 may be made of an anti-radiation material, but this is often not required because the device is placed on a shielded support). For this purpose, it comprises a central cylindrical housing 34 opening into the lower face 20, as shown in FIG. 4. An axis 36 extends perpendicular to the platen 32 and is engaged in the housing 34. The axis 36 has a diameter corresponding substantially to the inner diameter of the housing 34, to the close operating clearance, so as to allow the rotation of the barrel about the axis 36 (which coincides with the axis A). At the base of the barrel 12, fixed against the lower face 30, there is a crown 38, possibly toothed, surrounding the axis 36. The crown 38 allows driving in rotation, for example by a belt (not shown), the barrel 12 on the axis 34. This belt is also engaged on a drive pulley (no shown) secured to an output shaft of a motor assembly 40 of a barrel, mounted on the platen 32.

In the present variant, the barrel 12 comprises four cells 14 (also individually designated 14.1 to 14.4) capable of receiving vials for the preparation of solutions. These cells 14 are designed to open into the upper face 22 of the barrel 12. The cells 14 are preferably of cylindrical shape (circular section or other), but advantageously have their axis (B) inclined relative to the vertical, for example by 15 to 20°.

This facilitates the withdrawal from the bottom of the vial when the remaining volume is small. The diameter of the barrel 12, and the dimensions of the cells depend on the vials to be accommodated and therefore the intended applications. For example, the cells 14 may have a depth of between 35 and 70 mm. The inlet diameter of the cells 14 is adapted to the vials and the passage section of the opening 24 is preferably slightly less than the inlet diameter of the cells 14.

It will be noted, in particular in FIG. 3, that the barrel 12 comprises in fact a fifth cell 15, called housing, provided to accommodate lead (the cell is empty in FIG. 3). In this housing 15 a lead element 17 is thus placed, for example a disk or cylinder complementary in shape to the housing (FIG. 2) 15. This lead element 17, when it is aligned with the opening 24, allows closing this opening 24 and constitutes a shield which blocks the emission of radiation towards the outside of the casing through the orifice 24.

As will be understood, the drive means constituted by the motor assembly 40 connected to the crown 38 allows the barrel 12 to pivot so as to be able to selectively align each of the cells 14.1 to 14.4 with the opening 22, thus allowing access to the vials contained in these cells from the outside of the casing, forming the working positions. The drive means also allows the barrel 12 to be in the closing position, in which the housing 15 is aligned with the opening 24 and the lead element 17 seals the opening 24.

Some construction details of the barrel 12 can be underlined. The barrel 12 can be manufactured of any material and by any suitable method. In particular, it can be advantageously made of a rigid polymer, such as ABS. 3D printing is an advantageous manufacturing technique, but other techniques can be used. The four cells 14.1 to 14.4 intended to accommodate flasks and the cell 15 accommodating the lead disk 17 have the center of their upper openings, in the plane of the upper face 22 of the barrel, equidistant from the axis of rotation A. Of course, this distance is substantially the same as the distance from the axis A to the center of the opening 24. Therefore, this allows aligning, as desired, any of the cells 14.1 to 14.4 and 15 with the opening 24, by pivoting the barrel about its axis.

Preferably, at least one of the cells 14 is designed as an insert. In the variant, the cell 14.4 comprises a tubular jacket closed at its lower end, which is positioned in a hollow region of the barrel 12. The jacket 42 comprises an upper rim 44 by which it bears on the upper face 22 of the barrel.

For certain applications, it is desirable to be able to monitor the temperature of a vial placed in the barrel 12. Heating and/or cooling means can therefore be provided for one or more cell(s). In the present variant, a heating resistive wire 42.1 is preferably wound around the jacket 42. A forced cooling of this jacket 42 is obtained by means of a fan (not shown) placed in the hollow region of the barrel 12, which has an opening 46 in the side face 28, under the cell 15. A series of lamellar openings 48 are also made in the side wall 28 of the barrel 12.

Preferably, each cell 14 with a vial is equipped with a temperature sensor 19 (FIG. 4). The cell 14.4 may comprise 2 temperature sensors.

A precision balance 21 (FIG. 4) is advantageously provided at the bottom of each cell 14.1 to 14.4. The balances allow knowing in real time the volume present in each vial.

Means for detecting an (hourly) angular positioning of the barrel are advantageously provided for an increased accuracy of the positioning of the barrel 12 relative to the orifice 24. Optical means (not shown) are preferred. For this purpose, the barrel is equipped with a barcode determining the position of each cell 14.1 to 14.4 and 15. A barcode reader is placed in the covering 16.

The presence, on each cell 14.1 to 14.4 of a disinfection means should be further noted. This disinfection means may comprise a ramp of UV emitting lamps around 254 nm (for example LEDs), positioned on the upper circumference (inlet) of the cell and oriented towards the inside of the cell, towards the upper face of the vial. The ramp of LEDs is indicated 23 in FIG. 4.

This allows keeping the top face of the vials clean, while avoiding the use of alcohol which would eventually soil the wells. The use of these ramps, which encroach little or no on the opening of each cell, has inter alia a bactericidal, germicidal, virucidal effect on the exposed surfaces.

Referring mainly to FIGS. 2 and 7, the syringe actuating means 26, which is mounted on the platen 32 at the rear of the barrel 12, will now be described in detail. It comprises two mobile elements 52 and 54 (simply referred to as 'mobile members') sliding vertically along two fixed axes 56 and 58, which are smooth and vertical; and driven along these axes 56, 58 by means of two worm screws 60 and 62 formed by threaded rods. Each of the mobile members 52, 54 comprises a horizontal support plate 52.1, 54.1 with two orifices traversed by the sliding axes 56, 58. Each support plate 52.1, 54.1 carries, at the sliding orifices, a guide sleeve 64 aligned with the latter, to improve the horizontal stability during the displacement along the axes 56, 58.

The lower support plate 52.1 comprises an orifice through which the worm screw 60 passes and a thread pitch formed by an internally threaded sleeve 66, fastened on the support plate 52.1 and aligned with said orifice. The thread pitch of the sleeve 66 corresponds to that of the worm screw 60 and therefore allows the ascension or descent of the support plate 52.1 along the worm screw 60, in the direction of rotation of the screw 60. The screw 60 is driven in rotation by a first motor assembly 67 resting on the platen 32.

The upper support plate 54.1 comprises a (smooth) passage orifice for the worm screw 60 which drives the lower support plate 52.1. It further comprises an orifice through which the other worm screw 62 passes, associated with a thread pitch formed by an internally threaded sleeve 68, fastened on the support plate 54.1 and aligned with said orifice. The thread pitch of the sleeve 68 corresponds to that of the worm screw 62 and therefore allows the ascension or descent of the plate 54.1 along the screw 62, in the direction of rotation thereof. The screw 62 is driven in rotation by a second motor assembly 70 fastened to the lower support plate 52.1. Owing to lack of space, the second motor assembly 70 is preferably fixed under the lower support plate 52.1 and the connection with the worm screw 62 is made through an orifice formed in the plate 52.1.

As will be understood, the actuation of the first motor assembly 67 alone allows a simultaneous displacement of the support plates 52.1 and 54.1, which is useful to displace the entire syringe relative to the barrel. The actuation of the second motor assembly 70 causes a relative displacement between the two support plates 52.1 and 54.1, which therefore allows displacing the plunger of the syringe relative to the syringe body. A position sensor, for example of the potentiometer type, is advantageously associated with each mobile member 52 and 54 in order to determine their respective vertical position with a good accuracy. Knowing the relative displacement between the two mobile members 52, 54 allows knowing the stroke of the plunger and therefore calculating the volumes which are introduced into the syringe body or expelled.

The presence of two parallel vertical side uprights 72, facing each other at the longitudinal ends of the support plates 52.1 and 54.1, will also be noted. They each comprise, on their inner faces, vertical guide means for the mobile members, here in the form of a vertical rib 74 of a triangular profile, placed in the center of the upright. Each support plate comprises at its longitudinal ends a triangular incision 76 whose shape corresponds to the ribs 74, to improve the stability of the guidance.

Each of the two mobile members 52, 54 comprises gripping means for the syringe. The reference sign 80 designates an actuating arm of a triangular shape, secured to the upper support plate 54.1, protruding from the side of the barrel 12. It ends with a coupling portion 82 with a horizontal groove 84 in which the plunger head of the syringe is housed. The arm 80 is slidably mounted on a pair of rails 81 fastened to the second plate 54.1, in order to move toward the syringe plunger head to engage it, or to be spaced apart therefrom. This displacement is controlled by a motor assembly 83 driving a worm screw.

The syringe body is, in turn, received and blocked in the syringe carrier 27 associated with the support plate 52.1. The syringe carrier 27 comprises, in the manner of a box, a base 86 and a cover 88 pivoting relative to this base thanks to a lateral hinge 90 (FIGS. 8 and 9). A lock (not shown remotely controlled) is provided to hold the cover 88 in the closed position on the base 86. The inner portions facing the base 86 and the cover 88 each comprise a footprint so as to define a housing for the syringe body, ensuring the holding of the syringe body in the horizontal and vertical plane. FIG. 8 shows the footprints 92, 92' for the cylindrical syringe body, and horizontal slots 93, 93' for accommodating the end flange of the syringe body.

As clearly shown in FIG. 5, when the cover 88 is closed, the syringe body 90 is firmly held in the syringe carrier 27 secured to the lower support plate 52.1 and the syringe plunger 92, whose end is engaged in the actuating arm 80 secured to the upper support plate 54.1, can be manipulated individually by actuating the second motor assembly 70.

It will also be noted that the syringe carrier 27 is mounted on a support 94, which slides on two horizontal smooth rods 96, transversely to the vertical axis of displacement of the syringe carrier 27 by means of the mobile members 52 and 54. To this end, the support 94, which has for example a square plate shape, comprises on the rear face two cylindrical bearings 98 in which the rods 96 are engaged. As clearly shown in the figures, the rods 96 are fixedly held parallel at their ends by two arms 100 secured to the lower support plate 52.1. A drive means is provided for displacing the syringe carrier support 94 along the rods 96, for selectively positioning the syringe carrier 27 on either side of the barrel 12 to bring the syringe to a device or accessory placed right next to the barrel 12. The reference sign 101 designates a motor assembly fastened on the outer side of an arm 100. The drive of the syringe carrier support 94 is displaced on the rods 96 by means of a belt (not shown) which is driven by the motor 101 and supported by a pulley (not shown) fastened on the arm 100 opposite to the motor 101.

It will also be noted that the syringe carrier 27 is advantageously movably mounted relative to its support 94, in order to be capable of lowering the syringe carrier 27 relative to the vertical position of the lower support plate 52.1.

In particular, the syringe carrier 27 can be moved laterally and lowered, to bring the syringe carrier 27 into a counting well (not shown) in order to measure the radioactive dose contained in the syringe. It will also be possible to deposit the syringe on a collection support.

In order to allow dose measurement when the syringe is in the syringe carrier 27, the latter is preferably made of a material that does not block radiation from radionuclides, for example of rigid plastic.

In FIG. 9, the syringe carrier 27 is lowered relative to its support 94. The syringe carrier 27 is connected to the support 94 by means of two drive links (wires) (not shown) which are actuated by a motor assembly 102. Two centering cones 104 are disposed vertically and fastened to legs 106 secured to the upper edge of the support 94. The centering cones 104 cooperate with conical housings 108 in the upper face of the base 86 of the syringe carrier 27. The drive links are guided vertically through a central passage in the centering cones 104 and also pass through the conical housings 108.

We will now focus on FIGS. 5 and 6 which respectively illustrate a working position and the closing position of the barrel. In FIG. 5, the barrel 12 is positioned with the housing 14.1 aligned with the opening 24. The syringe carrier 27 rests on its support 94 and the mobile member 52 is in the low position: the needle 110 fastened to the end of the syringe 29 is in the cell 14.1 and is engaged in a vial 112. As will be understood, in this position of the mobile member 52 and the syringe carrier 27, it is possible to manœuvre the syringe plunger 92 using the mobile member 54 to withdraw liquid from the vial, or inject an amount from the syringe into the vial 112.

These withdrawal or injection operations can be carried out for a vial housed in any one of the cells 14.1 to 14.4, by aligning the cell with the opening 24, that is to say in the working positions of the barrel 12.

It will also be noted in FIG. 5 that the sidewall 18 of shielded covering 16 also comprises a rear wall 18.1, thus enclosing the entire periphery of the barrel 12.

In FIG. 6 the barrel 12 is in an angular position in which the cell/housing 15 carrying the lead disc 17 is aligned with the opening 24: it is the closing position of the barrel 12. Before taking this position, the syringe carrier 27 is of course raised, to disengage the syringe 29, respectively the needle, from the orifice 24. In the closing position, the lead disc 17 seals the opening 24, physically shutting the communication with the interior of the covering 16, and also blocking the emissions from isotopes through the opening 24. An operator can then manipulate the syringe carrier 27, especially for the placement of a new syringe, without fear of taking a rate of radioactive doses at the tip of his fingers.

In terms of control, the device preferably comprises a control module managed by a software, preferably external to the device, for monitoring: the rotational movements of the barrel, the movements of the mobile members 52 and 54 and thus keeping a history (log) of withdrawn amounts, and the movements of the syringe carrier 27.

Example of Use of the Present Device for the Preparation of RPM Injections.

In the present example, four vials are loaded into the barrel 12, for the preparation of two RPMs for bone and cardiac scintigraphy, as a practitioner can do it daily. The device 10 will be, in use, typically placed in a shielded glove box.

The first vial, referred to as "source pot", contains the metastable Technetium 99 (Tc 99m*) isotope initially diluted in 5 ml of aqueous sodium chloride (NaCl). We do not speak of concentration for the measurement in this case, but of volume radioactive activity which depends on the elution age of the technetium (withdrawal from the mother fountain present in the preparation enclosure). A source pot at t=0 generally presents an activity of 5 billion becquerels (5 GBq), activity that decreases by half every 6.02 h. For indication, a patient dose is of the order of 0.6 GBq.

All preparations are made from this source pot. There are two types of preparations carried out by the device:

labelling, that is to say the preparation of a pot for a specific marker (example: bone pot); and fractionation, that is to say the withdrawal from a single-use syringe of a dose of drug needed by the patient.

Each type of scintigraphic examination requires its specific marker that will be the vector of technetium to the region to be explored and thus its own pot. The device ensures the preparation of two types of markers as soon as it is necessary, and a first time at the beginning of the session.

The second vial contains the NaCl necessary to carry out dilutions.

The third vial will become the bone marker for bone scintigraphy. A vial as it is sold filled with HDP (Hydroxidiphosphonate (HDP)/Osteocis) in the form of a powder is initially loaded into the cell. The device 10 is responsible for filling this third vial with the Tc+NaCl solution. The barrel 12 is then rotated to facilitate the dilution of the powder in Tc+NaCl. The ideal volume activity is 750 Mbq/mL.

The fourth vial will become the cardiac marker for cardiac scintigraphy. The vial as it is sold filled with mibi (sestamiBi) in the form of a powder is initially loaded into the cell, in particular cell 14.4. The device is responsible for filling this fourth vial with the Tc+NaCl solution. The barrel 12 is then rotated to facilitate the dilution of the powder in Tc+NaCl. The heating function of cell 14.4 is also activated. The ideal volume activity is 260 Mbq/mL. The prescriptions of the vector manufacturers will generally be followed.

Typically, the balances enable the device in real time to know the volume present in each vial, the heating device only concerns the cardiac marker (mibi). Before labelling, the device will withdraw NaCl from the dedicated vial to dilute the source pot, then withdraw from this source pot, the required activity to be injected to perform a reconstitution (labelling) of a kit depending on the activity of the day or a request of the user.

Fractionation: the dose to be prepared for the patient is unique and depends on the weight of the patient. It is read by the operator from a weight-dose chart.

In conventional practice, the operator withdraws from a syringe, and based on its experience, a volume of radioactive drug from a source pot corresponding at first sight to the need for product according to the weight of the patient and then measures the dose contained in the syringe in a counting well that will measure the radioactivity. If the "amount" of radioactivity does not correspond to what is necessary for the patient, it is necessary, in conventional preparation methods, to manually adjust the dose present in the syringe to or from the source pot and repeat the measure as many times as necessary to arrive at a measure corresponding to the amount of radioactivity required by the patient.

It will be appreciated that the fractionation is largely facilitated by the present device 10. Knowing the volume and the activity in the source pot, the device 10 does not need to perform the "round trips" described above, and withdraw at once, from the requested kit, the volume corresponding to the requested activity. Then, the syringe is measured in a counting well contained in the preparation enclosure thanks to the lateral translation on the rods 96, before being deposited in a tungsten protective case, when the preparation is finished.

Of course, the invention is not limited to the embodiment which has just been described by way of example, but covers all variants thereof. In particular, the barrel 12 is a particular achievement of a movable support block, but could take other forms to achieve the vial receptacle function with its cells/wells.

The invention claimed is:

1. A device for preparing radioactive solutions, in particular radiopharmaceutical solutions, comprising:

a movable support block comprising at least two cells capable of accommodating a vial;

a shielded covering, comprising a side wall surrounding the periphery of the support block and an upper wall covering the upper face of the support block, an opening being provided in the upper wall of the covering;

a means for driving the support block configured to selectively displace the support block into positions, referred to as working positions, in which a given cell is aligned with the opening to allow access to said cell from the outside of the covering;

a syringe carrier associated with a syringe actuating means configured to displace a syringe substantially vertically in the axis of the opening and to actuate a plunger of said syringe; and wherein the support block is configured such that it can be further brought to a position, referred to as closing position, in which the opening is sealed by a shielded element carried by the support block.

2. The device according to claim 1, wherein the shielded element carried by the support block is integral with the support block or attached therein.

3. The device according to claim 2, wherein said shielded element is a lead element, for example a disc, placed in a housing opening into an upper face of the movable support block.

4. The device according to claim 1, wherein the movable support block is a rotatably mounted cylindrical barrel, and wherein the cells open into the upper face of the barrel.

5. The device according to claim 1, wherein the cells capable of accommodating vials are cylindrical cells inclined relative to the vertical.

6. The device according to claim 1, wherein one or more of said cell(s) comprise(s):

a temperature sensor; and/or a precision balance at the bottom of the cell; and/or a disinfection device comprising UV lamps, around the inlet of the cell.

7. The device according to claim 1, comprising means for detecting the angular position of the movable support block.

8. The device according to claim 1, wherein heating and/or cooling means are associated with at least one of said cells.

9. The device according to claim 8, wherein a cell is made as an insert mounted in a hollow portion of the support block, the heating and/or cooling means comprising a heater resistor mounted on a jacket disposed in a cell, as well as a fan mounted in the support block and ventilation openings in the side wall of the support block.

10. The device according to claim 1, wherein the syringe actuating means comprises:

a first mobile member to which the syringe carrier is secured, the syringe carrier ensuring holding the syringe body; and a second mobile member with means for coupling to the syringe plunger;

the syringe actuating means being configured to, either simultaneously displace the first and second mobile members, or to perform a displacement of the second mobile member relative to the first mobile member.

11. The device according to claim 10, wherein translation means are mounted on the first mobile member in order to displace the syringe carrier laterally relative to the support block; and/or the syringe carrier is associated with a support and comprises means to displace the syringe carrier downwardly relative to the support thereof.

12. The device according to claim 1, wherein the shielded covering and the shielded element carried by the support block are made of an anti-radiation material.

13. The device according to claim 12, wherein said anti-radiation material is lead or lead-based material.

14. The device according to claim 4, wherein said cylindrical barrel is rotatable about a substantially vertical central axis.

15. The device according to claim 7, wherein said means for detecting the angular position of the movable support block are optical detection means.

* * * * *